US005765966A

United States Patent [19]

White et al.

[11] Patent Number: 5,765,966

[45] Date of Patent: Jun. 16, 1998

[54] SUB-SURFACE TRENCHING AND BACKFILL APPARATUS

[76] Inventors: Thomas B. White, 491 N. Main St.; Bruce A. Peterson, 19 Parkside Ave., both of Southampton, N.Y. 11968

[21] Appl. No.: 724,325

[22] Filed: Oct. 1, 1996

[51] Int. Cl.[6] ..... E01C 19/12; E02F 5/10

[52] U.S. Cl. ..... 405/174; 404/108; 405/179; 405/180; 405/182

[58] Field of Search ..... 405/149, 150.2, 405/174, 179–184; 404/101, 108, 102, 120

[56] References Cited

U.S. PATENT DOCUMENTS

| | | | |
|---|---|---|---|
| 1,006,116 | 10/1911 | Morse | 405/174 X |
| 3,508,411 | 4/1970 | Rogers | 405/182 |
| 3,604,215 | 9/1971 | Dunn | 405/174 X |
| 3,611,730 | 10/1971 | Brettrager | 405/50 |
| 3,670,512 | 6/1972 | Grazier et al. | 405/182 |
| 3,874,182 | 4/1975 | Potter et al. | 405/179 |
| 3,898,940 | 8/1975 | Ede | 111/200 |
| 4,003,339 | 1/1977 | Hostetler | 119/57.4 |
| 4,142,817 | 3/1979 | Lazure | 405/174 |
| 4,629,363 | 12/1986 | Rose et al. | 405/180 X |
| 4,790,687 | 12/1988 | Wright | 405/174 X |
| 5,281,054 | 1/1994 | O'Riordan | 405/180 X |

OTHER PUBLICATIONS

Cambridge Sportsturf Drainage, 4–Page Brochure with 2–Page "Instant Retrofit" and Super Retrofit insert, and 2–Page Stadium and Super Stadium insert.

*Primary Examiner*—Tamara L. Graysay
*Assistant Examiner*—Tara L. Mayo
*Attorney, Agent, or Firm*—Samuel M. Learned, Jr.

[57] ABSTRACT

A soil sub-surface trenching apparatus adapted to deliver a ribbon deposit of an aggregate material to form a downwardly extending curtain thereof below the soil surface level and thereby provide a soil conditioning method for accomplishing a wide range of subsoil characteristic modifications, being as varied as surface level drainage enhancement with the use of a porous aggregate material in recreational and agricultural applications and the like to that of soil subsurface stabilization improvement with the use of a solidifying aggregate material for surface level vehicular parking applications and the like.

18 Claims, 7 Drawing Sheets

SUB-SURFACE TRENCHING AND BACKFILL APPARATUS

BACKGROUND OF THE INVENTION

This invention relates to an apparatus and method for accomplishing a wide range of soil sub-surface conditionings, being as varied as that of from drainage enhancement to stabilization for increased bearing load support.

Typically there are two types of sub-soil trenching and aggregate deposit apparatus employed in accomplishing soil sub-surface conditioning, and in both instances the apparatus may be either mounted on a self-propelled or towed vehicle.

The first type of trenching and aggregate material deposit apparatus embodies a mechanical digging mechanism such as a rotating forward driven trenching wheel with earth lifting blades exemplified by that as shown and described in U.S. Pat. No. 3,611,730 to Brettrager dated Oct. 12, 1971, or alternately a forward moving upward lifting excavating conveyor type mechanism as taught by Potter et al in U.S. Pat. No. 3,874,182 dated Apr. 1, 1975. In both of these teachings the soil removed to form the trench is replaced with an aggregate material transported along with the apparatus, which aggregate material is then backfilled into the formed trench to provide a porous drainage channel and thereby promote enhanced drainage removal of excess surface water. Also, as is the case in both of the foregoing teachings, because of the apparatus size and operational characteristics they tend to literally tear up the turf, thus the respective apparatus thereof are not suitable for employment in drainage enhancement applications where disturbance of the surface level turf must be kept to a minimum, such as is both desireable and required in drainage enhancement work on golf course greens and fairways as well as athletic field surface level drainage enhancement applications.

The second type of sub-soil trenching and aggregate deposit apparatus employed for accomplishing soil sub-surface conditioning employs a vibratory plow blade with a blade-trailing aggregate material deposit chute for accomplishing backfilling of the formed trench to provide a porous drainage channel. Exemplary of this second type of sub-soil trenching and aggregate deposit apparatus would be those as respectively taught in U.S. Pat. No. 3,508,411 to Rogers dated Apr. 28, 1970, and U.S. Pat. No. 3,898,940 to Ede dated Aug. 12, 1975. In this second type of machine a trench is formed by the forward pulled advance of a vibratory plow, which forms a soil sub-surface trench by cutting, being thereby much less invasive or damaging to the surface level turf than is a digging type apparatus, which makes the vibratory plow type apparatus more suitable and desireable for golf course greens and fairway, as well as athletic field, surface level drainage enhancement applications. However, when the aggregate deposit chute of this type apparatus is directly affixed in a blade-trailing connection to the vibratory plow as is shown in the Ede teaching, even this type apparatus can also be excessively disturbative of surface level turf in golf course and athletic field surface level drainage enhancement applications. Alternately, when the aggregate deposit chute is loosely affixed in blade-trailing connection to the vibratory plow by linkage means as is shown in the Rogers teaching, a similar excessive surface level turf disruptive result is obtained.

As improvements over the foregoing the applicants herein, by their invention teach an apparatus and method which provides both new and novel approaches to effect clean and efficient sub-surface trenching and soil conditioning in applications where it is required that there be a minimum of surface level turf disturbance.

SUMMARY OF THE INVENTION

It is the principal object of the present invention to provide a soil sub-surface trenching apparatus for sub-surface delivery therefrom of a ribbon deposit of an aggregate material to form a downward extending curtain thereof for purposes of subsoil characteristic modification.

It is another object of the present invention to provide a soil sub-surface trenching apparatus that is adapted for retrofit installation assembly upon a typical self-propelled prime mover equipped with a vibratory drive attachment.

It is also an object of the present invention to provide a soil sub-surface trenching apparatus having a centerless auger for continuous delivery of aggregate material from the apparatus aggregate hopper to the trenching blade-trailing aggregate feed chute for deposit of aggregate material in backfilling the soil sub-surface trench.

It is an additional object of the present invention to provide a soil sub-surface trenching apparatus having a vibratory trenching blade and a trenching blade-trailing aggregate feed chute having a spring-loaded mechanical tracking means which enables accurate delivery and maintenance of depth of aggregate material deposit backfilling in the soil sub-surface trench.

It is a further object of the present invention to provide a soil sub-surface trenching apparatus which opens, fills and covers a sub-surface aggregate filled trench with minimum disturbance of the surface level turf.

It is yet another object of the present invention to provide a soil sub-surface trenching apparatus adapted to handle and deliver to soil sub-surface deposit within the formed trench a porous aggregate material.

It is also an object of the present invention to provide a soil sub-surface trenching apparatus adapted to alternately handle and deliver to soil sub-surface deposit within the formed trench a solidifying aggregate material.

Still another object of the present invention is to provide a soil sub-surface trenching and aggregate material deposit method for accomplishing various of a wide range of subsoil hydraulic or support characteristic modifications.

Even yet another object of the present invention is to provide a soil sub-surface trenching apparatus and method that are respectively easily operated and practiced by persons of ordinary skill.

The foregoing, and other objects hereof, will be readily evident upon a study of the following specification and accompanying drawings comprising a part thereof.

DETAILED DESCRIPTION OF THE INVENTION

Figure 1:
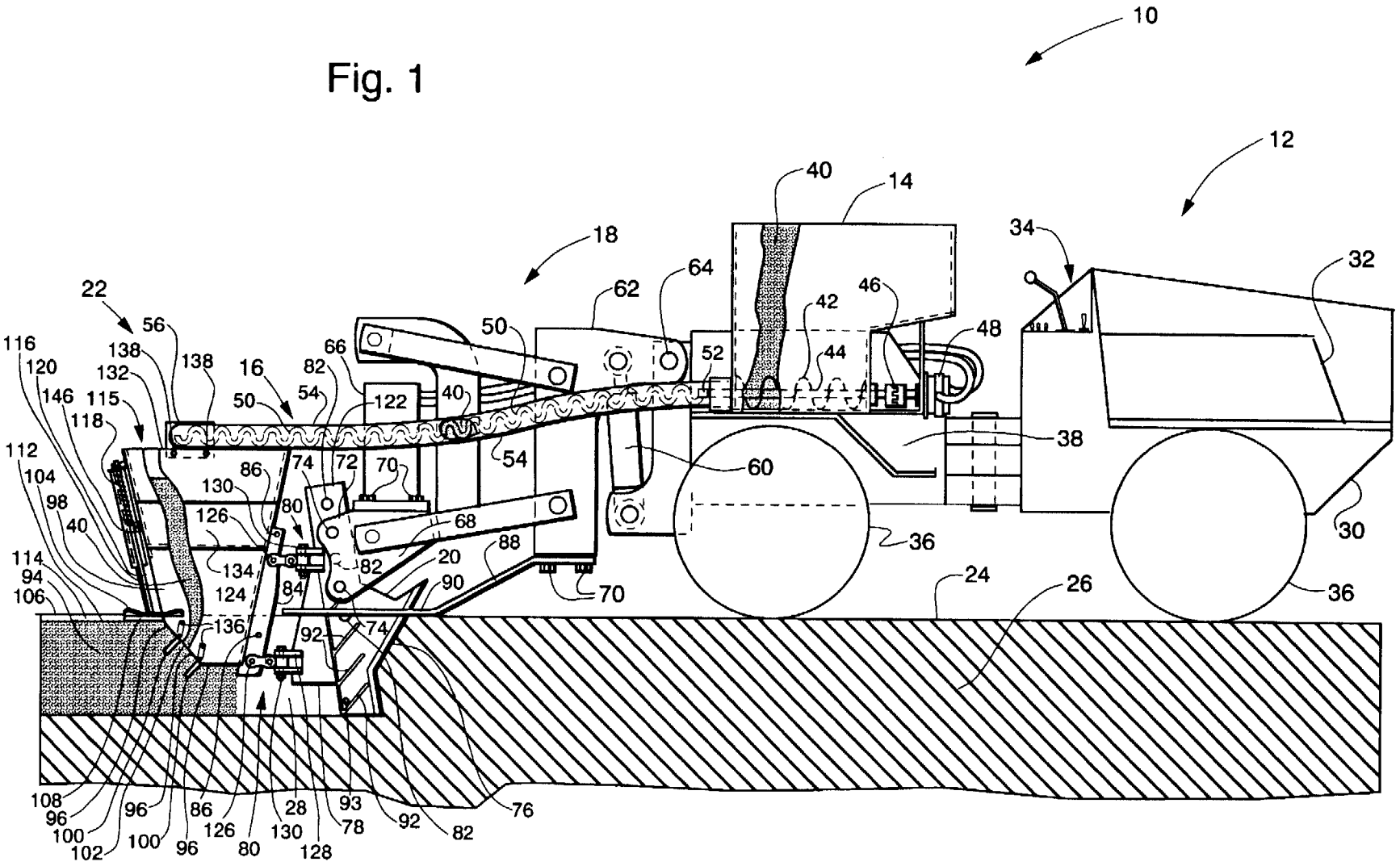
FIG. 1 is a side elevation view of the preferred embodiment soil sub-surface trenching apparatus, being shown operationally installed upon a typical self-propelled prime mover equipped with a vibratory drive attachment.

Referring to FIG. 1, the soil sub-surface trenching apparatus 10 of present invention and the major component parts thereof comprising the same are shown in exemplary retrofit installation upon a typical self-propelled prime mover 12 adapted to supportably mount the aggregate feed hopper 14 and centerless auger assembly 16 of said apparatus 10, which prime mover 12 is further equipped with a vibratory drive attachment 18 adapted to connectably support and operationally position the vibratory trenching blade 20 and trenching blade-trailing aggregate feed chute 22 of said apparatus 10.

Referring again to FIG. 1 to explain in greater detail the elements and novel features of the present invention. As shown, the prime mover 12 with apparatus 10 assembled thereto is disposed upon the ground surface level 24 of the soil 26 with the soil sub-surface trenching apparatus 10 operationally engaged to form and aggregate back-fill a soil sub-surface trench 28. The prime mover 12 is provided with a chassis 30 which mounts a prime mover power unit 32 and control console 34 to respectively propell and guide the prime mover 12 as transmitted through the tires 36 thereof upon the surface level 24. Assembled to the prime mover frame 38 by conventional connection means is the aggregate feed hopper 14 and associated centerless auger assembly 16. The feed hopper 14 is adapted to receive and direct aggregate material 40 to the hopper auger 42 which is driven by means of shaft 44 connected by coupling 46 to the hydraulic drive motor 48. It will also be noted that the centerless auger assembly flites 50 are connected by flite connector 52 to shaft 44 and are likewise driven thereby to rotationally deliver aggregate material 40 from the feed hopper 14 down the flexible centerless auger delivery tube 54 to the trenching blade-trailing aggregate feed chute 22, the delivery end of which flexible centerless auger delivery tube 54 is connected to the aggregate feed chute 22 by means of bracket 56.

In operation the vibratory drive attachment lift cylinder 60 is retracted which pivots the vibratory drive attachment frame 62 about pintle 64 to insert the vibratory trenching blade 20 into the soil 26 for operational use employment as shown. In order to facilitate trenching blade 20 soil 26 insertion, the hydraulic vibrator motor 66 is activated through control console 34 to transmit high frequency vibration through the blade mount 68 to which the vibrator motor 66 is attached by means of bolts 70, and thence to the trenching blade 20 in turn connected to the blade mount clevis 72 by pins 74. The particular hydraulic vibrator motor 66 as shown and illustrated herein is of the type employing a hydraulic ram driven in reciprocation by the hydraulic control system, and is to be considered as exemplary only. Other types of vibratory motors that could be equally well employed would include a rotary vibrator of the inertia type, or alternately an electromagnetic vibrator motor.

The high frequency blade vibration imparted by motor 66 also facilitates cutting of the soil 26 and any soil debris or obstacles therein by the sharpened vibratory trenching blade cutting edge 76 during forward displaced movement of the prime mover 12, as well as transmitting aggregate material flow and distribution discharge assisting vibration to the trenching blade-trailing aggregate feed chute 22 attached in horizontal and vertical pivotal connection to the integral blade rudder 78 through pivot link assemblies 80. It will be noted that the vibratory trenching blade 20 is provided with a plurality of clevis connection openings 82 by which said blade 20 may be assembled in vertically adjusted disposition with respect to the blade mount clevis 72 in order to thereby accommodate an increased or decreased range of operational soil depth penetration by the blade 20. Likewise, the aggregate feed chute connector bar 84 is similarly provided with alternate link connection openings 86 by which the trenching blade-trailing aggregate feed chute 22 may in a like manner also be assembled in a variably vertically adjusted disposition in order to thereby accommodate blade depth set with an increased or decreased range of operational trench depth deposit of aggregate material 40.

Other structural features with respect to operation of the vibratory trenching blade 20 include the resilient turf compressor bars 88, which bars are assembled in a laterally spaced parallel relationship one to the other to the underside of the vibratory drive attachment frame 62 by means of bolts 70 as is shown, said bars being laterally spaced by a dimension which is sufficient to closely accommodate the width of blade 20. The compressor bars 88 are configured to have a spring resilience in operational application so that the respective laterally spaced trailing feet 90 thereof function to compressively engage the turf at ground surface level 24 in a close parallel laterally spaced relationship either side of said blade 20 as said blade 20 is vibratorily displaced by the self-propelled prime mover 12 in forming a soil sub-surface trench 28, and thereby prevent a vibratory blade cutting disruption of the turf at ground surface level 24. Complementary to the compressor bars 88 in further preventing ground surface level disruption during operation of the soil sub-surface trenching apparatus 10 are the outward protruding blade vanes 92, which are profiled at a surface level directed forward-raked angle and operate as the blade 20 forms the soil sub-surface trench 28, within and along the trench sides during trench formation, to block rising particulate soil matter and direct it downward back along the blade sides and into the formed trench so as not to have a vibratory throwing out of soil along the trench sides at the ground surface level. And, at thus bottom rear of the trenching blade 20, a pipe pulling connector attachment opening 93 is provided from which a pipe pulling connector attachment 95 as later shown in FIG. 4 may be assembled to pull and lay a perforated plastic drainage pipe 97 in the bottom of the trench 28 simultaneous with trench forming and backfilling operations.

Considering now structural and operational details of the trenching blade-trailing aggregate feed chute 22 as shown in FIG. 1, which is the means whereby aggregate material 40 is back-filled into the soil sub-surface trench 28 to provide an effective soil sub-surface aggregate filled surface water drainage channel 94. As shown in FIG. 1, the aggregate material 40 is delivered from the aggregate feed hopper 14 by means of the centerless auger assembly 16 which interconnects the feed hopper 14 to the trenching blade-trailing aggregate feed chute 22 by means of the flexible centerless auger delivery tube 54 within which the centerless auger assembly flites 50 rotationally operate to continually convey aggregate material 40 to the feed chute 22 at a rate adequate to maintain a sufficient supply of aggregate material 40 therein for operational back-fill delivery thereof to the soil sub-surface trench 28 as it is progressively formed by the vibratory trenching blade 20 during forward displaced movement of the self-propelled prime mover 12. Dispensing of the aggregate material 40 from the feed chute 22 is by gravity feed therefrom downwardly through the fixed slotted openings 96 at the bottom of the aggregate feed chute trench vane 98, whereby aggregate material 40 is thereby back-fill deposited in the soil sub-surface trench 28 to form the soil sub-surface water drainage channel 94.

As was previously mentioned, controlled vibratory impulses are transmitted from the vibratory trenching blade 20 through the interconnecting pivot link assemblies 80 to the aggregate feed chute connector bar 84, and thence to the interconnected aggregate material feed chute 22 and depending integrally connected aggregate feed chute trench vane 98. The operational benefit of the aforementioned vibratory impulse transmission is three fold. First, such vibratory impulse action promotes uniform fluidized flow of aggregate material 40 from the feed chute 22, downwardly into and through the aggregate feed chute trench vane 98, and therefrom through the fixed slotted openings 96 thereof for uniform back-fill deposit of aggregate material 40 into the soil sub-surface trench 28 to form the soil sub-surface aggregate filled surface water drainage channel 94. Second, such vibratory impulse action functions to operate the angularly downward depending tamping fingers 100 connected to the aggregate feed chute trench vane trailing edge 102, which thereby progressively tamps aggregate material 40 into the soil sub-surface trench 28 as it is deposited therein to form the soil sub-surface aggregate filled surface water drainage channel 94. And thirdly, such vibratory impulse action further functions to impart a vibratory tamping motion to both the foot valve shoe 104 as it cooperatively functions with the outward protruding blade vanes 92 to prevent aggregate material throw-out from the trench 28 and also smooth the surface level trench edge turf 106, in addition to imparting a vibratory tamping motion to the foot valve shoe keel 108 in effecting a compression to a uniform recessed finished depth of the drainage channel aggregate material top 112 in forming the drainage channel surface recess 114 which thereby facilitates the surface level trench edge turf 106 in quickly growing over the recess 114 to efficiently level as well as conceal the soil sub-surface aggregate filled surface water drainage channel 94.

Figure 4:
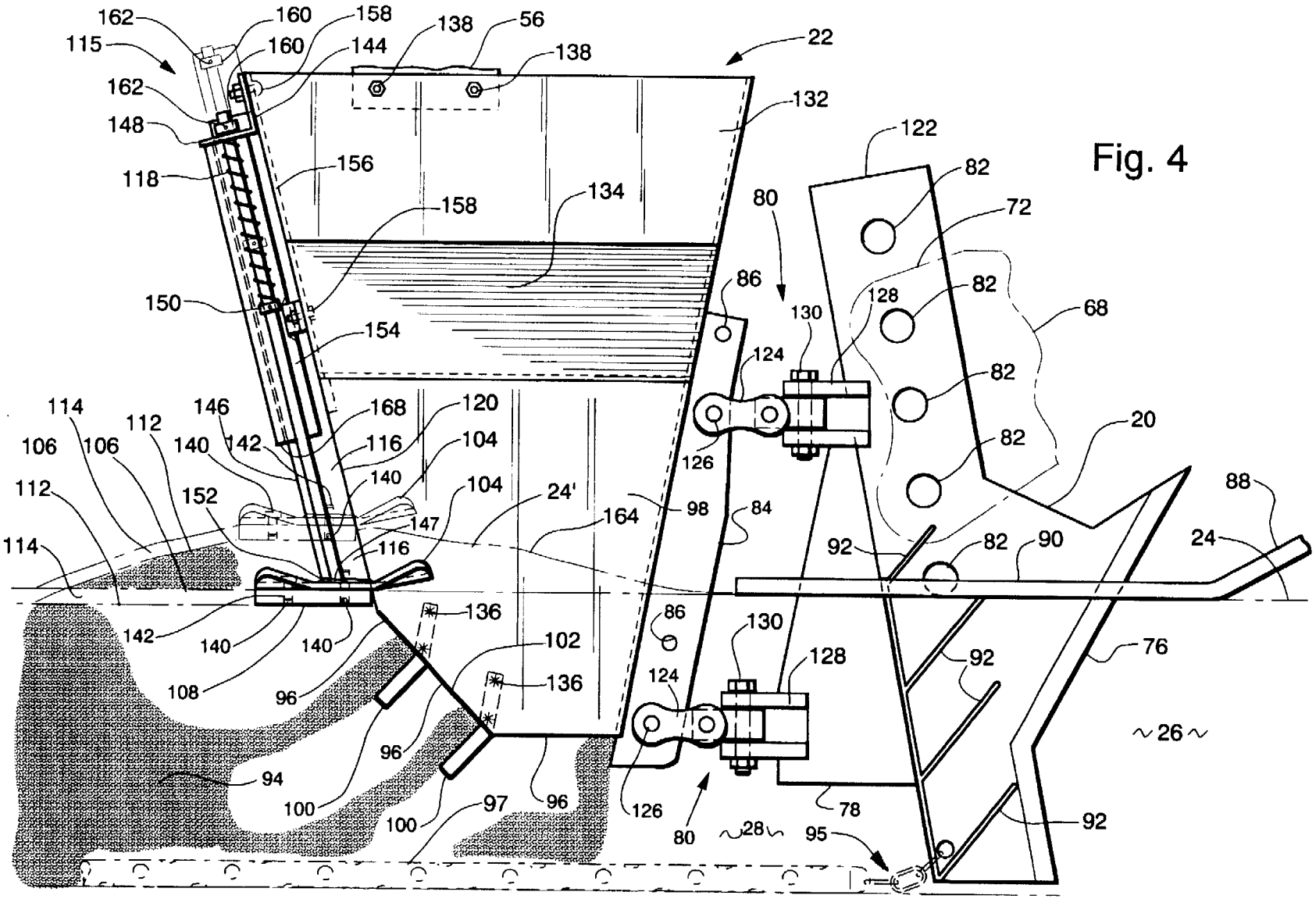
FIG. 4 is a side elevation view similar to that shown in FIG. 3, herein however showing, in phantom, operation of the feed chute follower shoe in operationally accommodating differences in terrain profile irregularities.
Figure 7:
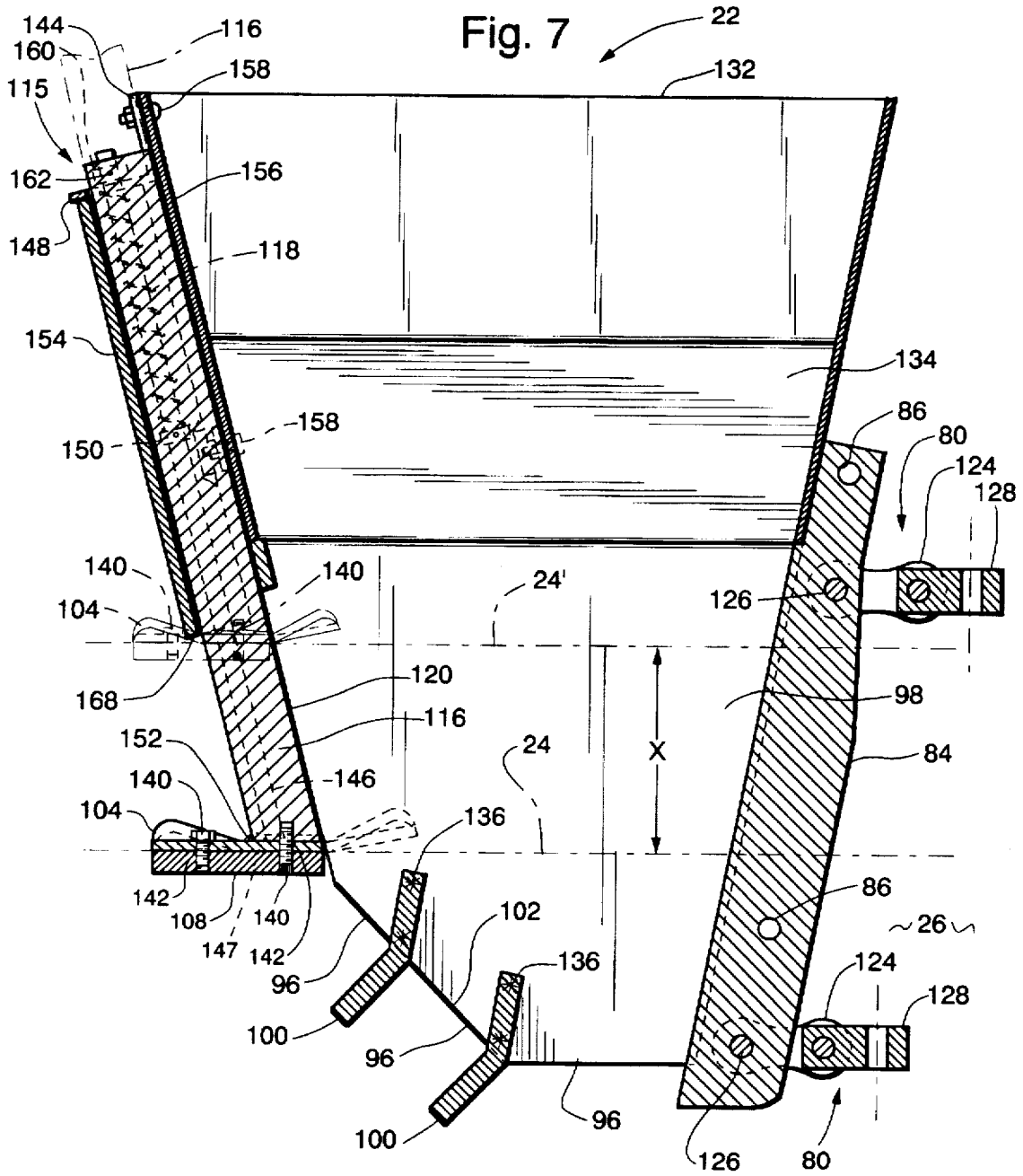
FIG. 7 is an enlarged vertical section view of the trailing aggregate feed chute as shown in FIG. 6 and seen along the line 7—7 thereof.

Other structural and functional features of the trenching blade-trailing aggregate feed chute 22 shown in FIG. 1 include the spring biased foot valve actuating assembly 115 whereby the foot valve shoe 104 is caused to compressively track the surface level trench edge turf 106, and further whereby the foot valve shoe 104 deflectively elevates the variable slotted opening gate 116 against compressive pressure of springs 118 to open the variable slotted opening 120 of the aggregate feed chute trench vane 98 for increased aggregate material 40 flow in deposit thereof into deeper soil sub-surface trenches 28, all of which will be as more fully explained hereinafter in greater detail on consideration of FIGS. 4 and 7.

The soil sub-surface trenching apparatus 10 may be fabricated by accepted manufacturing methods and techniques from various materials such as metals and alloys thereof, or plastics, or combinations of metals, metal alloys, and plastics.

Figure 2:
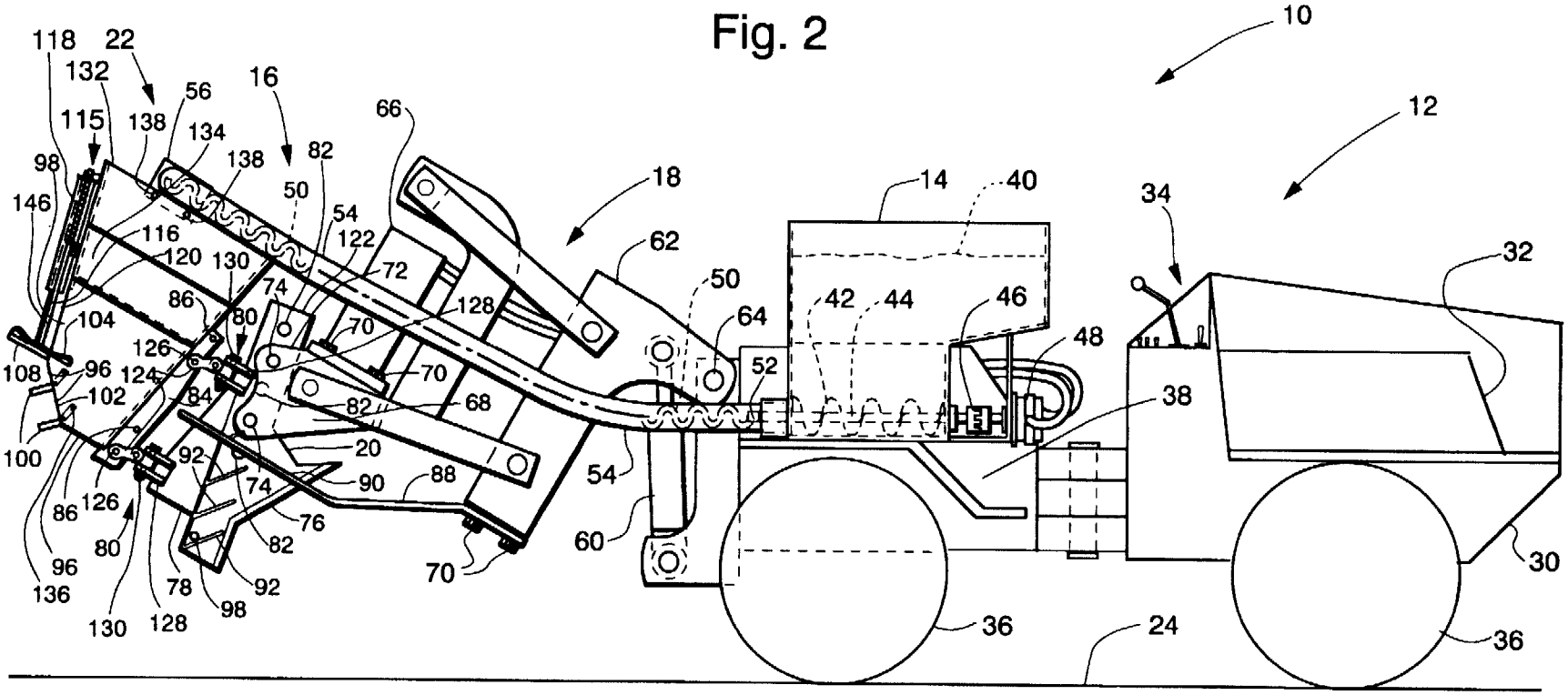
FIG. 2 is a side elevation view similar to that shown in FIG. 1, illustrating, however, the soil sub-surface trenching apparatus in transport position.

Turning attention now to FIG. 2, wherein is shown the soil sub-surface trenching apparatus 10 with vibratory drive attachment lift cylinder 60 in an extended position for transport displacement, which would be the normal machine configuration for relocation of said apparatus 10 from one operational use position to another. It should be noted that employment of a centerless auger assembly 16 which is provided with a flexible delivery tube 54 enables quick and efficient disengagement and movement to transport position of the apparatus 10 when displacing from one operational use position to another, and then the re-engagement thereof for continuing trench 28 construction.

Figure 3:
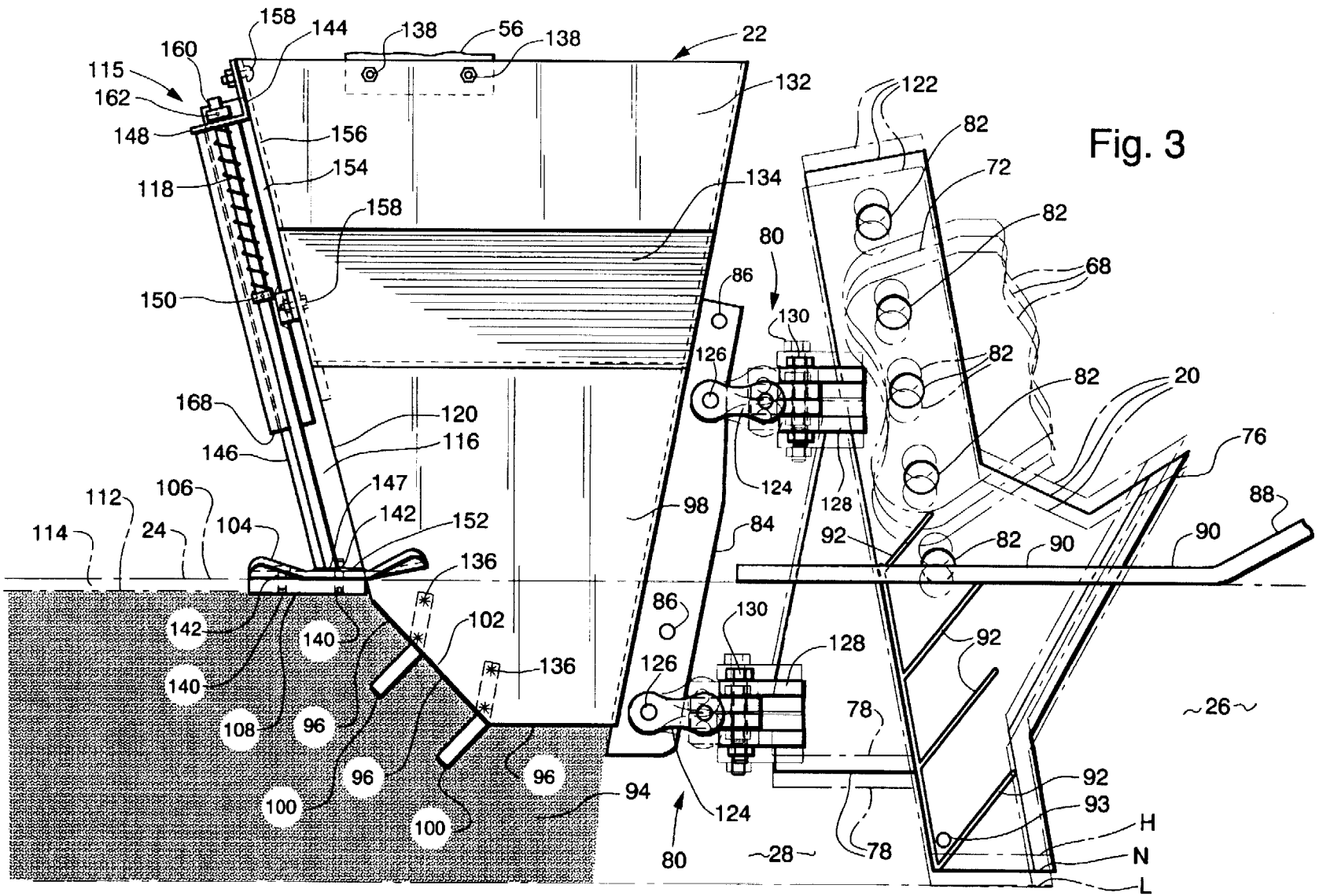
FIG. 3 is an enlarged side elevation view of the trenching blade and trailing aggregate feed chute of the soil sub-surface trenching apparatus of instant invention.

Referring now to FIG. 3, which shows greater structural, operational, and adjustment detail of the vibratory trenching blade 20, the feed chute 22, and the respective sub-assembly components thereof. Considering first the trenching blade 20 depth adjustment features.

Depth of the trench 28, and corresponding soil sub-surface aggregate filled surface water drainage channel 94 is accommodated in one of two ways, or a combination thereof. First, the elevation of extension of the vibratory drive attachment lift cylinder 60 may be employed to incrementally adjust the trench 28 depth from normal N, to high H, to low L as shown at the bottom of blade 20 in FIG. 3, which incrementally moves the entire blade 20 assembly up or down as also shown therein in phantom rendition. It will further be noted that the pivot link assemblies 80 pivotally displace to accommodate such blade 20 elevation adjustment with respect to the feed chute 22. Secondly, greater incremental elevational changes of the blade 20 to accommodate either deeper or shallower trench 28 depths is accomplished by re-connecting the blade mount clevis 72 to either a higher or lower set of clevis connection openings 82 on the blade shank 122. And thirdly, accomplishing blade 20 depth adjustment by employing a combination of clevis 72 to blade shank 122 re-connection with a variable elevation of extension of the vibratory drive attachment lift cylinder 60.

Considering next elevation setting and depth adjustment of the trenching blade-trailing aggregate feed chute 22, which is accommodated and accomplished by re-connection of the vertical pivot links 124 from the primary link connection openings 126 to the alternate link connection openings 86, which will set the aggregate feed chute trench vane 98 lower in order to thereby in turn accommodate back-fill of a deeper trench 28. A shallower set of blade 20 does not necessitate a depth adjustment re-set of the feed chute 22 as such is accommodated by deflection of the vertical pivot links 124.

Lateral tracking of the feed chute 22 with respect to the blade 20 within the trench 28 as it is progressively formed is accommodated by the feed chute hinge connectors 128 of the pivot link assemblies 80. As shown in FIG. 3, the hinge connectors are assembled by pivot bolts 130 which not only allow for lateral tracking pivot deflection of the trench vane 98 with respect to the blade 20 as is more clearly shown in FIG. 6 to be further explained hereinafter, but also allows for disassembly of the blade 20 from the feed chute 22 for sharpening of the blade cutting edge 76 as well as other blade 20 maintenance and repair operations such as welding bead re-building of worn outward projecting blade vanes 92.

Other structural features of the feed chute 22 more clearly shown in FIG. 3 include the shape thereof which is that of an open top rectangular material receiving bin 132 adapted to hold and dispense the aggregate material supply as delivered thereto from the feed hopper 14 by means of the centerless auger assembly 16. Directed gravity dispensing of aggregate material 40 from the receiving bin 132 to the trench vane 98 for back-fill deposit of aggregate material 40 to the trench 28 is accommodated by the angularly inward depending feed chute lateral sides 134 interconnecting the receiving bin 132 of said feed chute 22 to the trench vane 98 thereof. The foregoing feed chute 22 structure is more clearly shown as illustrated in the FIG. 5 rear elevation view thereof to be hereinafter more fully described, and the fluidized flow of aggregate material 40 therethrough is enhanced by the vibratory impulse effect transmitted from the vibratory trenching blade 20 through the pivot link assemblies 80 as was previously described.

As also more clearly shown in FIG. 3, the angularly downward depending tamping fingers 100 are assembled to the trench vane 98 by means of spot welds 136, and the bracket 56 for holding the delivery end of the flexible centerless auger delivery tube 54 is secured to the rectangular aggregate material receiving bin 132 side by means of bracket bolts 138.

Lastly with regard to apparatus 10 structural considerations as shown in FIG. 3, attention is directed to the spring biased foot valve actuating assembly 115. As was previously described, the foot valve shoe 104 with foot valve shoe keel 108 affixed thereto by means of keel screws 140 are the functional components of the assembly 115 in first operating to prevent aggregate material 40 throw-out from behind the trench vane 98 during trench 28 back-fill operations, as well as with respect to the keel 108 in both forming the drainage channel surface level recess 114 and smoothing and tamping the drainage channel aggregate material top 112. It should be noted that the width and depth of the drainage channel surface level recess 114 can be altered in profile by changing the keel 108 to one having rectangular dimensions either larger or smaller by utilizing keel screws 140 threadably connecting into threaded shoe openings 142 through the top and bottom of the foot valve shoe 104 as shown.

Additional structural and functional components of the spring biased foot valve actuating assembly 115 include the foot valve assembly mounting bracket 144 to which is assembled a spaced pair of shoe mounting rods and spring guides 146 being at the bottom ends thereof weldably connected by rod welds 147 to the top side of the shoe 104 and at the upper ends thereof respectively adapted to retain and guide a spring 118 between the mounting bracket top flange 148 and spring retaining collar 150. Stabilization and reciprocating guidance of the shoe 104 against the compressive force of springs 118 in accommodating turf profile irregularities during operational backfill employment is provided by slidable operation of the variable slotted opening gate 116, also weldably connected by gate weld 152 centrally intermediate the longitudinal axis top of shoe 104 as shown, up and down within the mounting bracket gate guide 154 which is attached to the rectangular aggregate material receiving bin rear wall 156 by a plurality of mounting bracket bolts 158. Removal of the foot valve shoe 104 from the spring biased foot valve actuating assembly 115, should such become necessary, is accomplished by removal of the rod retaining collars 160 held by set screws 162 which thereby releases the shoe 104, rod 146, and gate 116 assemblies for slidable downward removal.

Considering now FIGS. 1–3 with respect to the method of employment of the soil sub-surface trenching apparatus 10. First, as is therein shown and hereinafter described, the self-propelled prime mover 12 with the vibratory drive attachment 18 held in a transport position by extension of the vibratory drive attachment lift cylinder 60 as shown in FIG. 2, is moved to and located for operational soil 26 insert of the vibratory trenching blade 20 with trenching blade-trailing aggregate feed chute 22. Second, the hydraulic vibrator motor 66 is activated to impart a variable high frequency vibratory impulse within a range of from 0 up to 2,400 cycles per minute to the trenching blade 20 while at the same time retracting the lift cylinder 60 and imparting forward driven displacement to the prime mover 12, all of which effects mechanical soil 26 insertion of the blade 20 and trench vane 98 to the set operational depth for trench 28 forming and backfilling. And third, upon activation of the centerless auger assembly 16 there is effected conveyancing of aggregate material 40 from the feed hopper 14 to the feed chute 22 for trench vane 98 dispensing of aggregate material 40 in backfilling of the trench 28 and progressive formation of the soil sub-surface aggregate filled surface water drainage channel 94 as illustrated respectively in FIGS. 1 and 3.

In accomplishment of the method above-described and inherent thereto during operational employment of the soil sub-surface trenching apparatus 10, stabilization of the blade 20 within the trench 28 is enhanced by the blade rudder 78 as the blade 20 displaces forward, and soil fines are contained within the trench 28 by the outward protruding blade vanes 92 while throw-out of turf is contained and prevented by the blade tracking laterally spaced trailing feet 90 of the resilient turf compressor bars 88. Concurrently, tracking rearwardly of the blade 20 within the trench 28 the feed chute 22 deposits aggregate material 40 through both the fixed slotted openings 96 and variable slotted opening 120 of the trench vane 98 in backfill of the trench 28 while the vibratory impulse imparted to said feed chute 22 as transmitted from blade 20 through the pivot link assemblies 80 maintains a fluidized aggregate material 40 flow through the trench vane 98, as well as operating the angularly downward depending tamping fingers 100 to progressively impact and compact the aggregate material 40 in the backfill of said trench 28. Further, and rearward of the feed chute 22 the spring biased foot valve activating assembly 115 compressively operates to hold the foot valve shoe 104 downwardly against and track the surface level trench edge turf 106 to thereby contain and prevent throw-out of either soil 26 or aggregate material 40 behind the trench vane 98, while at the same time positioning the foot valve shoe keel 108 to both compress and compact the drainage channel aggregate material top 112 and to also form a drainage channel surface level recess 114 just below the surface level trench edge turf 106 whereby turf recovery cover-over of the soil sub-surface aggregate filled surface water drainage channel 94 is thereby facilitated.

It should be noted that the aggregate material 40 for formation of surface water drainage channels 94 is preferably crushed stone or coarse sand, or a combination thereof. However, any impervious particulate material of the proper size which would allow for ease of mechanical handling in the apparatus 10 and provide a suitable surface water drainage medium when employed in the manner described may just as suitably be employed. Also, it should be further noted that in the alternate utilization of the apparatus 10 and method hereof for providing soil sub-surface stabilization, the aggregate material to be employed in that application would be dry mix concrete installed in the same manner wherein soil moisture and surface water runoff would activate the dry mix concrete which would then harden and form a soil embedded sub-surface upward projecting ribbon of hardened material to provide surface level support such as in sodded parking areas, grass airport runways, and along road shoulders. Utilization of the apparatus 10 in this latter application for forming a plurality of parallel sub-surface concrete support ribbons, or a grid pattern of intersecting such ribbons, is that alternate employment of said apparatus 10 as was previously stated in soil sub-surface conditioning methodology.

Turning attention now to FIG. 4, wherein is illustrated versatility of the spring biased foot valve actuating assembly 115 in accomodating uniform backfill when a ground surface level irregularity 24' is encountered. As is sometimes the case in various turf drainage and stabilization applications hereinbefore described, ground surface level irregularities 24' such as the ground hump 164 shown in FIG. 4 may be encountered which would result in a corresponding irregular depth of trench 28 backfill. In order to accommodate such surface level irregularities as a ground hump 164, and still maintain a uniform depth of trench 28 backfill whether it be with porous or solidifying backfill aggregate material 40 in either soil sub-surface drainage or stabilization applications, compressive deflection of the foot valve shoe 104 against springs 118 as caused by slidable tracking contact thereof with the ground surface level irregularity 24' elevates the variable slotted opening gate 116 by an amount corresponding to a progressive variation in the ground hump 164 elevation to thereby open said gate 116 and dispense additional aggregate material 40 through the variable slotted opening 120 and in turn progressively backfill the trench 28 elevation differential caused by said ground hump 164 while at the same time maintaining a uniform trench 28 depth and backfill thereof, being as shown in phantom line rendition of the spring biased foot valve actuating assembly as shown in FIG. 4. On the other hand, depressions in surface level turf profile are simply accommodated by trenching, tracking and backfilling the same as if the terrain were of uniform profile elevation without the need or necessity for a variable depth of trench 28 backfill capability.

Also shown in FIG. 4 at the bottom of the trenching blade 20 as previously described is the pipe pulling connector attachment opening 93 with an exemplary pipe pulling connector attachment 95 installed to simultaneously pull and lay an exemplary perforated plastic drainage pipe 97 in the bottom of the trench 28 during trench forming and backfilling operations. The purpose for installing a perforated plastic drainage pipe 97 in the manner above described would be to supplement and facilitate drainage removal of water in areas of high surface and ground water content.

Figure 5:
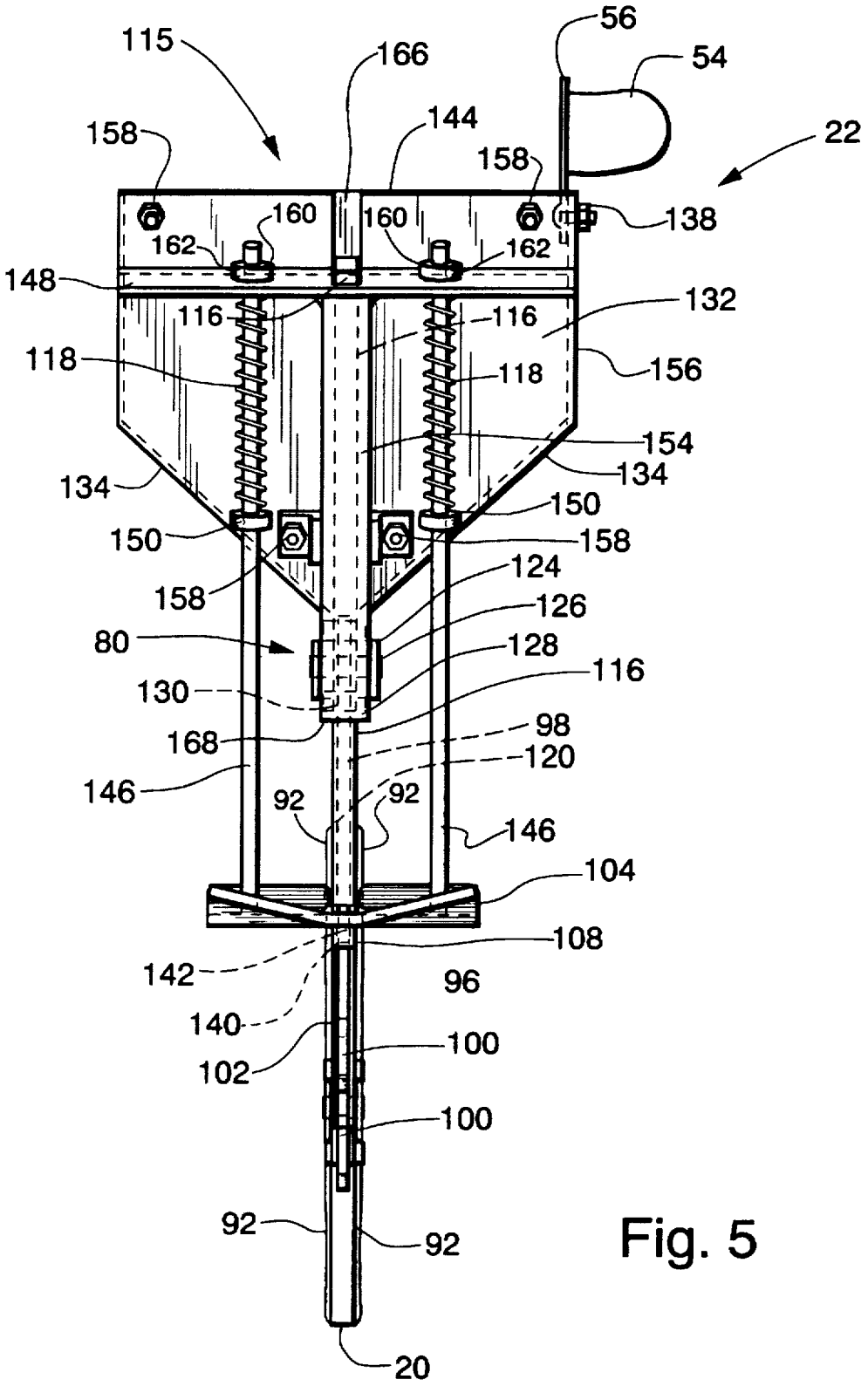
FIG. 5 is a rear elevation view of the trailing aggregate feed chute.

Referring now to the rear end elevation view of the feed chute 22 as shown in FIG. 5, which illustrates in more particular detail shape and structural relationships of the rectangular aggregate material receiving bin 132 to the angularly inward depending feed chute lateral sides 134, and joinable connection at the bottoms of said lateral sides 134 to the aggregate feed chute trench vane 98. Further shown in FIG. 5 in better structural detail relationship is the spring biased foot valve actuating assembly 115, and the mounting bracket gate slot 166 which allows for reciprocal elevational movement of the variable slotted opening gate 116 at times of foot valve shoe 104 tracking of ground surface level irregularities 24' such as ground hump 164 as was previously described.

Figure 6:
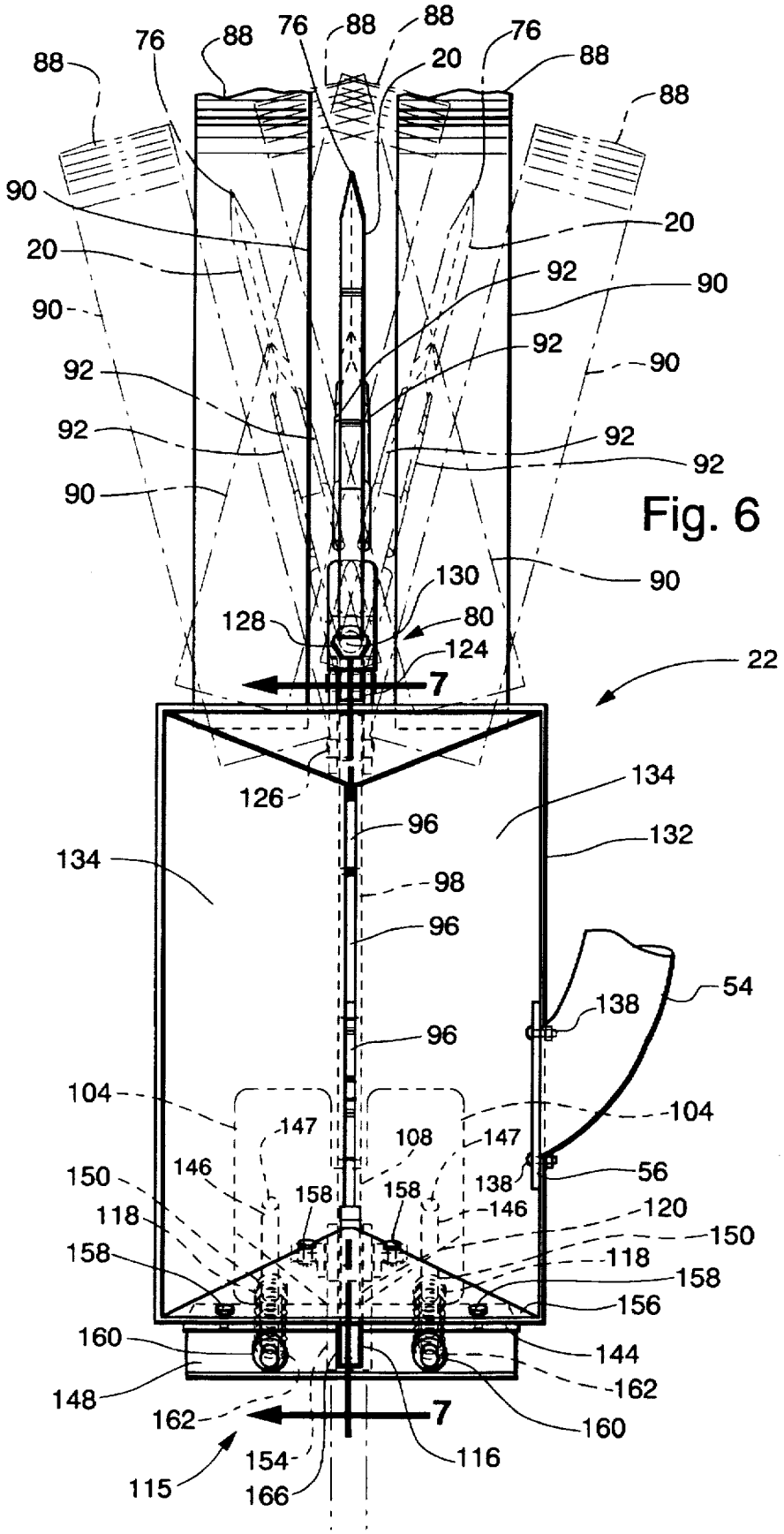
FIG. 6 is a top plan view of the trenching blade and trailing aggregate feed chute showing in phantom the turn radius capabilities of the trenching blade to left and right of center in forming a trench.

Turning now to a consideration of FIG. 6, which is included to show still further structural relationship detail of the feed chute 22, but more particularly to illustrate the angular deflective capability of the blade 20 in accommodating laterally angled directional changes during trench 28 operational formation. As shown, blade 20 tracks directional displacement of the prime mover as illustrated by corresponding directional change of the laterally spaced trailing feet 90, in pivotal deflection with respect to the feed chute 22, about pivot bolts 130. Upon such directional change the feed chute trench vane 98, through pivotal link assemblies 80, in turn pivotally deflects within the confines of the previously formed trench 28 to track blade 20 in the new direction of trench 28 formation.

Lastly, attention is directed to FIG. 7 which depicts the range of foot valve shoe 104 deflective capability in accommodating variable differentials in turf profiles from an operational ground surface level 24 through a ground surface level irregularity 24', which is a vertical ground surface level irregularity differential of "X" being between the operational 24 and the irregular 24' profile surfaces as shown in phantom line rendition in FIG. 7, wherein it will be noted that the bottom of the mounting bracket gate guide 154 operates as a shoe stop 168 to limit the maximum vertical displacement deflection of said shoe 104 against compressive force of springs 118.

Although the soil sub-surface trenching apparatus invention hereof, as well as the structural characteristics and method of employment thereof, respectively have been shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. A soil sub-surface trenching and backfill apparatus adapted to form a soil sub-surface trench and deliver thereto a ribbon deposit of an aggregate material backfill to form a downwardly extending curtain thereof below the soil surface level, said soil sub-surface trenching and backfill apparatus comprising in combination a self-propelled prime mover provided with a control and a vibratory drive attachment assembled thereto, an aggregate material backfill feed hopper assembled to said prime mover and adapted to receive and dispense said aggregate material backfill by means of a flexible centerless auger assembly, a trenching blade detachably assembled to said vibratory drive attachment and having an elevation and lowering means to raise and lower said trenching blade above and below said surface level, a blade-trailing aggregate material backfill feed chute detachably connected pivotally to said trenching blade to receive said aggregate material backfill dispensed thereto by said flexible centerless auger, and a spring biased foot valve activating assembly connected centrally intermediate vertically to the trailing end of said blade trailing aggregate material backfill feed chute being adapted to deliver said aggregate material backfill in said ribbon deposit therefrom in backfill to said soil sub-surface trench.

2. A soil sub-surface trenching and backfill apparatus according to claim 1 wherein said aggregate material backfill is a particulate substance through which an accumulation of soil surface and sub-surface water may percolate.

3. A soil sub-surface trenching and backfill apparatus according to claim 2 wherein said particulate substance is crushed stone.

4. A soil sub-surface trenching and backfill apparatus according to claim 2 wherein said particulate substance is coarse sand.

5. A soil sub-surface trenching and backfill apparatus according to claim 2 wherein said particulate substance is a combination of crushed stone and coarse sand.

6. A soil sub-surface trenching and backfill apparatus according to claim 1 wherein said aggregate material is a dry mix concrete.

7. A soil sub-surface trenching and backfill apparatus according to claim 1 wherein said vibratory drive attachment is a hydraulic ram driven in reciprocation through said control.

8. A soil sub-surface trenching and backfill apparatus according to claim 7 wherein said hydraulic ram reciprocates at a vibratory impulse rate within a range of 0 up to 2,400 cycles per minute.

9. A soil sub-surface trenching and backfill apparatus according to claim 1 wherein said flexible centerless auger assembly is driven by a hydraulic motor.

10. A soil sub-surface trenching and backfill apparatus according to claim 1 further including a set of resilient turf compressor bars respectively adapted to support a corresponding laterally spaced trailing foot compressively against said soil surface level in close proximity either side of said trenching blade.

11. A soil sub-surface trenching and backfill apparatus according to claim 1 wherein said trenching blade is provided with a plurality of vertically spaced openings to detachably and adjustably assemble the same to a blade mount clevis affixed to said hydraulic motor.

12. A soil sub-surface trenching and backfill apparatus according to claim 1 wherein said trenching blade includes on either side thereof a vertically spaced upward angled forward facing plurality of outward protruding blade vanes.

13. A soil sub-surface trenching and backfill apparatus according to claim 1 wherein said elevation and lowering means for said vibratory drive attachment is a hydraulic lift cylinder.

14. A soil sub-surface trenching and backfill apparatus according to claim 1 wherein said blade-trailing aggregate feed chute is detachably connected pivotally to said trenching blade by means of a set of pivot link assemblies.

15. A soil sub-surface trenching and backfill apparatus according to claim 1 further including a set of angularly downward depending tamping fingers assembled to a trench vane trailing edge of said aggregate feed chute and adapted to tamp and compact the dispensed deposit of said aggregate material in backfill of said soil sub-surface trench.

16. A soil sub-surface trenching and backfill apparatus according to claim 1 wherein said trenching blade is provided with a pipe pulling connector attachment opening.

17. A soil sub-surface trenching and backfill apparatus according to claim 1 wherein said spring biased foot valve actuating assembly is provided with a foot valve shoe adapted by a spring resilience means to track the surface level trench edge turf profile whereby discharge dispensing of said aggregate material from said aggregate feed chute is contained and regulated to provide a uniform deposit depth to said soil sub-surface trench.

18. A soil sub-surface trenching and backfill apparatus according to claim 17 wherein said foot valve shoe is provided with a foot valve shoe keel adapted to further compact the dispensed deposit of said aggregate material in backfill of said soil sub-surface trench and form a uniform surface level recess therein.

* * * * *